United States Patent [19]

Rousseau

[11] Patent Number: 5,024,441

[45] Date of Patent: Jun. 18, 1991

[54] GOLFCOURSE SIMULATOR DEVICE

[76] Inventor: Claude Rousseau, 24 rue Sainte Félicité , 75015 Paris, France

[21] Appl. No.: 333,258

[22] Filed: Apr. 5, 1989

[30] Foreign Application Priority Data

Apr. 7, 1988 [FR] France ..... 88 04617

[51] Int. Cl.[5] ..... A63B 69/36

[52] U.S. Cl. ..... 273/176 R; 273/176 B; 273/176 FA; 273/176 FB; 273/181 E; 273/183 R; 273/184 R; 273/185 R; 273/185 B

[58] Field of Search ..... 273/176 R, 176 B, 176 E, 273/176 F, 176 FA, 176 FB, 181 R, 181 E, 181 F, 181 H, 35 R, 35 B, 183 R, 184 R, 185 R, 185 A, 185 B, 195 B, 87 R, 87 E; 340/323 R; 364/410; 434/252

[56] References Cited

U.S. PATENT DOCUMENTS

| | | | |
|---|---|---|---|
| 1,904,034 | 4/1933 | Walstrom . | |
| 2,465,418 | 3/1949 | Baker | 273/35 |
| 2,783,999 | 3/1957 | Simjian | 273/181 |
| 2,784,001 | 3/1957 | Simjian | 273/181 E |
| 3,114,554 | 12/1963 | Hurley | 273/176 |
| 3,184,239 | 5/1965 | Heuser | 273/176 |
| 3,501,152 | 3/1970 | Conklin et al. | 273/176 F |
| 3,559,996 | 2/1971 | Hopp | 273/181 H |
| 3,591,184 | 7/1971 | Conklin et al. | 273/181 E |
| 3,601,407 | 8/1971 | Lorrance | 273/176 H |
| 3,633,917 | 1/1972 | Anderson | 273/195 A |
| 3,639,923 | 2/1972 | Stewart | 273/187 R |
| 3,643,959 | 2/1972 | Cornell et al. | 273/176 FA |
| 3,655,202 | 4/1972 | Gautraud et al. | 273/176 FA |
| 3,684,293 | 8/1972 | Brooks | 273/176 F |
| 3,712,624 | 1/1973 | Conklin | 273/176 FA |
| 3,778,064 | 12/1973 | Nutter | 273/181 H |
| 4,045,023 | 8/1977 | Heffley, Jr. | 273/35 B |
| 4,086,630 | 4/1978 | Speiser et al. | 273/185 A |
| 4,133,534 | 1/1979 | Ikemoto | 273/176 E |
| 4,150,825 | 4/1979 | Wilson | 273/185 B |
| 4,177,994 | 12/1979 | Lindquist | 273/176 FA |
| 4,192,510 | 3/1980 | Miller | 273/176 A |
| 4,215,865 | 8/1980 | Pilati | 273/176 FA |
| 4,538,814 | 9/1985 | Cunningham | 273/176 F |

FOREIGN PATENT DOCUMENTS

| | | | |
|---|---|---|---|
| 2831383 | 2/1979 | Fed. Rep. of Germany . | |
| 2015351 | 9/1979 | United Kingdom . | |
| 2154146 | 9/1985 | United Kingdom | 273/185 A |

*Primary Examiner*—Edward M. Coven
*Assistant Examiner*—Jessica Harrison
*Attorney, Agent, or Firm*—Perry Carvellas

[57] ABSTRACT

A golf course simulator comprises a track running between a driving area and a target. The track incorporates a plurality of selectively openable and closable holes. The target marks the boundary between the virtual space in which an objective hole is situated in a first phase of the game, when the strokes played are swings, and a real space in which the objective hole is materialized by opening one hole, once the player has come close enough to the objective hole. The simulator is controlled by an appropriately programmed computer. For swings the driving area incorporates a ball sensor and the target incorporates an impact detector matrix. Measuring the time between the departure of the ball and the impact on the target, at a known distance, and location of the point of impact on the target supply initial speed, lift and drift information to determine the point of arrival of the ball in the virtual space and to deduce therefrom objective parameters. If the objective hole is in the real space one hole is opened and the length of the putt as determined by sensors arranged along the track results in the opening of another hole corresponding to the distance for the remaining putt or putts.

18 Claims, 4 Drawing Sheets

GOLFCOURSE SIMULATOR DEVICE

BACKGROUND OF THE INVENTION

1. Field of the invention

The invention concerns a device for simulating a golfcourse comprising a series of holes into which a player must direct a ball in corresponding successive stages, the ball being played from a start area to the hole forming the stage objective in a series of strokes.

2. Description of the prior art

On a real golfcourse where the distances between the start area and the objective hole are frequently as much as several hundred meters the strokes played by the players are of two kinds:

Firstly, long-distance strokes called "swings" or "long drives" where the player attempts to get the ball close to the hole, covering the greatest possible distance, possibly tens or even hundreds of meters.

Secondly, precision strokes or "putts" where the player attempts to reach the objective hole directly and the length of which rarely exceeds a few meters.

Players use specific clubs for each kind of stroke.

Evidently there is no clear-cut boundary between "swings" and "putts", the distinction depending partly on the skill of the player and partly on the configuration of the terrain around the hole.

As far as the applicant is aware, virtually all simulation devices previously proposed simulate only one of the two kinds of stroke, in the majority of cases putts.

However, some devices designed to simulate swings incorporate holes catering for simplified putting, with no obstacles. In these devices there is no interelationship between the swings and the putts.

The document U.S. Pat. No. 1,904,034 describes a putting simulator device with a track situated between a start area and a hole with a surface covering that simulates a lawn (green). The track can be tilted by means of a lever to return the ball to the player. A counter device registers entry of the ball into the hole and displays a successful stroke, while impact of the ball on a target behind the hole registers and displays a missed stroke.

The document U.S. Pat. No. 3,184,239 proposes a similar device except that there is a gully beyond the hole to recover balls which have gone past the objective hole and a scraper bar for returning balls that have stopped on the track as the result of a stroke that is too short.

U.S. Pat. Nos. 3,601,407 and 2,465,418 describe flexible material tracks that can be deformed to create bumps or hollows and increase the difficulty of the strokes. The first document discloses a single hole while the second discloses a plurality of holes.

U.S. Pat. No. 3,114,554 describes a track for training in putting with a plurality of holes which are opened one at a time in sequence. Control devices are provided to react to entry of a ball into an open hole, to open the next hole in the sequence and to display the results.

U.S. Pat. No. 4,133,534 describes a device similar to the previous one. The track comprises various obstacles; the holes are opened one at a time in sequence; when a ball enters the open hole the result is registered and then the hole is closed, ejecting the ball onto the track.

U.S. Pat. No. 3,633,917 describes a starting base for golf training but does not give any information as to the location or structure of the holes.

In this document the start configuration is variable; firstly three different types of starting terrain are available, disposed on a triangular prism-shaped rotor which rotates about a horizontal axis, one simulating a green, the second simulating a rough and the third simulating a bunker. This starting base is situated at the center of a platform that can be tilted about two orthogonal horizontal axes. Flexible aprons connect the platform to the surrounding surface.

Other documents are directed to training in swings.

U.S. Pat. No. 3,684,293 describes a tunnel-like cage. The walls of the cage, and in particular the back wall, comprise coatings selected to damp impact in a particular way. In this way it should be possible to evaluate the length of the swing and the effects imparted to the ball. As an accessory there is provision for training in putting by placing a hole in the cage.

U.S. Pat. No. 4,045,023 describes a device for training in swings which essentially comprises at a distance from a starting base a target provided with impact sensors and divided widthwise and heightwise in sectors. The division into widthwise sectors corresponds to the accuracy of the stroke in terms of direction while the heightwise division is used to evaluate the theoretical range of the stroke.

The description in this patent is full of ancillary and redundant descriptive material, such as the arrangement of the playing area in the form of an individual cabin; there is some doubt as to the feasibility of the real object of this patent.

Be this as it may, the prior art devices either offer sporting games similar to golf or can be used for training in this sport under severely restricted conditions. These devices fall a long way short of simulating the variety and the sequencing of strokes on a real golfcourse and of making it possible to evaluate the qualities of a player. In particular, none of these devices makes the conditions for any stroke dependent on the results of a preceding stroke and thus they do not simulate a course with a sequence of strokes in each stage (hole) in which the position of the ball as the result of one stroke determines the origin of the next stroke.

SUMMARY OF THE INVENTION

The present invention consists in a golfcourse simulator device comprising a series of holes into which a player must direct a ball in corresponding successive stages in each of which one hole constitutes a stage objective to which the ball advances from a start area, the player playing all his strokes from the same point and the progress of the ball along the course being simulated by displacement of the objective hole according to parameters of the preceding stroke, said device comprising a driving area, a first ball sensor in said driving area, an elongate track extending from said driving area, a plurality of selectively openable and closable holes on said track, a plurality of second ball sensors each associated with a respective hole, a plurality of third ball sensors disposed along the length of said track to determine the farthest position reached by a ball on said track after a stroke, a target closing said track at the end opposite said driving area and adapted to define a real space between it and said driving area and a virtual space on the side of said target opposite said driving area, a plurality of impact sensors on said target and control means including a computer programmed:

to define the series of stages each corresponding to a field extending from a start area to an objective hole and subdivided into an ordered plurality of contiguous cells memorized in said computer in the form of a file comprising plurality of blocks of information each associated with a respective one of said cells of said field and each containing data for identifying the associated cell relative to the start area and the objective hole for the stage in question;

to determine stroke parameters either from conditions of impact on said target or from the position of the ball on said track after the stroke according to whether the objective hole for the cell in which the origin of the stroke is simulated is in said virtual space or in said real space, respectively;

to determine the cell of said field in which the ball is located after a stroke from the stroke parameters and the cell reached after the preceding stroke;

to fetch from said file objective parameters associated with the cell reached after the preceding stroke, which parameters condition the opening of a particular hole on said track if said cell is in said real space; and to register the end of a stage in response to activation of one of said second ball sensors corresponding to entry of the ball into the opened hole.

It should be understood that if the objective hole is in the virtual space the player must attempt to get closer to the hole by playing swings with in each case the resulting virtual location of the ball being determined from the ball departure parameters: initial speed and orientation at the start of the trajectory, measured by the time interval between the departure of the ball and its impact on the target at a known distance on the one hand and from the position of the impact sensor on the target struck by the ball on the other hand; the virtual ball location after each swing becomes the basis for the next stroke, supplying information on the relative position of the objective hole of the next stroke relative to the starting point; subsequently, if the parameters of a swing place the final ball location in the real space the objective hole is materialized by opening the appropriate one of the multiplicity of holes; the player then starts putting and unsuccessful putts are measured by means of the third ball sensors to determine the position of the objective hole for the next putt, materialized by opening the appropriate hole.

An image synthesizer preferably produces a synthesized image on the target based on digital data stored in an information block associated with the cell of the stage field corresponding to the origin of the stroke, the image representing a panorama centered on the objective hole as seen from the stage field cell from which the stroke is played.

The driving area preferably comprises a plurality of stroke start areas adapted to be exposed individually and configured to simulate a kind of terrain, the information block associated with the stage field cell comprising specific data as to the nature of the terrain.

The first ball sensor is preferably a photoelectric device below an orifice on which the ball is placed so that the departure of the ball enables external light to impinge on the photoelectric device.

In a preferred embodiment the target comprises in longitudinal succession from a vertical rigid stop panel towards the driving area a first layer of rectilinear, parallel and regularly spaced conductors, a second layer of rectilinear, parallel and regularly spaced elastic conductors disposed parallel to the first layer with a gap between them, the conductors of one layer being horizontal and those of the other layer being vertical, and a flexible mat parallel to the stop panel and spaced from the second layer, the distances from the mat and the second layer to the stop panel being such that the impact of a ball on the mat pushes at least one conductor of the second layer into contact with at least one conductor of the first layer in line with the point of impact.

It will be understood that the contact between a specific wire of the first layer and a specific wire of the second layer as the result of an impact locates this impact in a way that is well suited to digitization of the impact point abscissa and ordinate. Each conductor of each layer is connected to one input of a matrix encoder. The layer of vertical wires gives information as to the direction of the stroke and the layer of horizontal wires gives information as to the lift which, in combination with the initial speed information obtained from the time for the ball to travel from the start area to the target, in combination with the distance separating the start area from the target, determines a range indication. If this distance is constant, at least for golf swings, the length of the swing can be determined by looking up a memorized stroke table with one input for the duration and another input for the lift.

Secondary characteristics and the advantages of the invention will emerge from the following description which is given by way of example only with reference to the appended diagrammatic drawings.

DESCRIPTION OF THE PREFERRED EMBODIMENT

Figure 1:
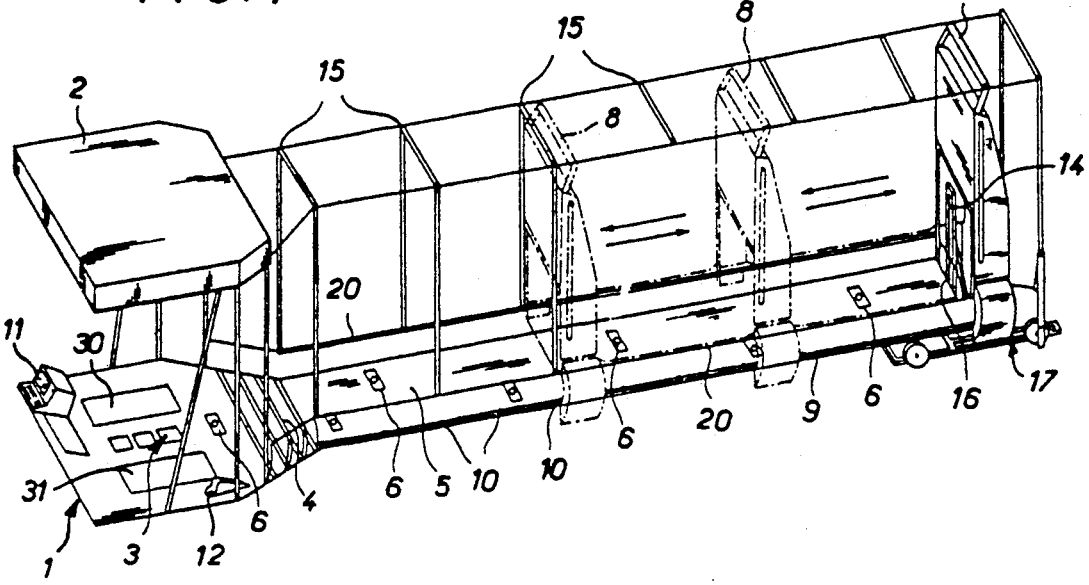
FIG. 1 is a general perspective view of a device in accordance with the invention.

In the selected embodiment shown in FIG. 1 the golfcourse simulator device essentially comprises a playing area 1 at one end of a track 5. The playing area 1 has a roof 2 provided with means (not shown) for illuminating the playing area 1 and the track 5 which is articulated relative to the playing area 1 to which it is joined by a flexible carpet 4. The playing area 1 includes a driving area 3 and the track 5 comprises a plurality of "retractable" holes 6 distributed along it at various distances from the driving area 3. A mobile target 8 is mounted to slide along the track 5 by means of a carriage sliding in rails.

The upper surface of the track 5 has a covering which simulates a green. The track 5 comprises, supported by articulated frames 15, a protective net (not shown to avoid overcomplicating the diagram) which forms the lateral walls and roof of a rectangular cross-section corridor open at one end to the playing area 1 and closed at the other end by the target 8. The net is held by appropriate means to the edge of the target 8, for example by magnets cooperating with the steel wires of the protective net. Balls played from the driving area 3 therefore remain within the corridor.

Figure 2A:
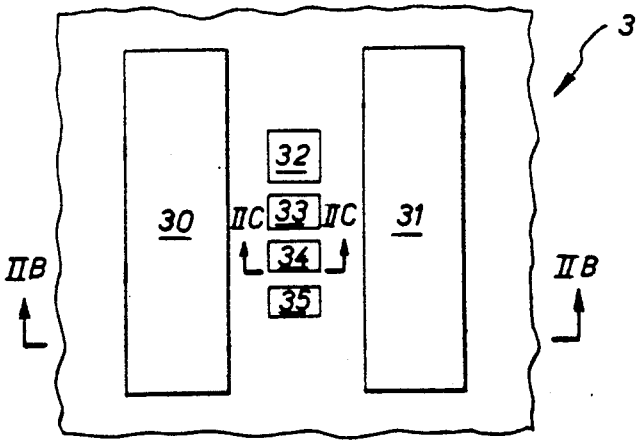
FIG. 2A is a plan view of the driving area.
Figure 2C:
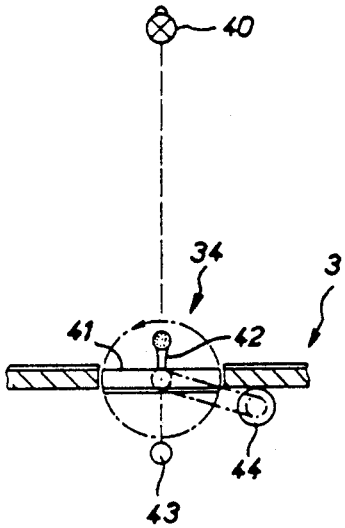
FIG. 2C is a cross-section on the line IIC—IIC in FIG. 2A.
Figure 2B:
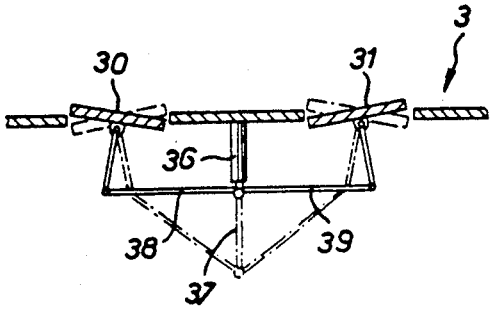
FIG. 2B is a cross-section on the line IIB—IIB in FIG. 2A.
Figure 3:
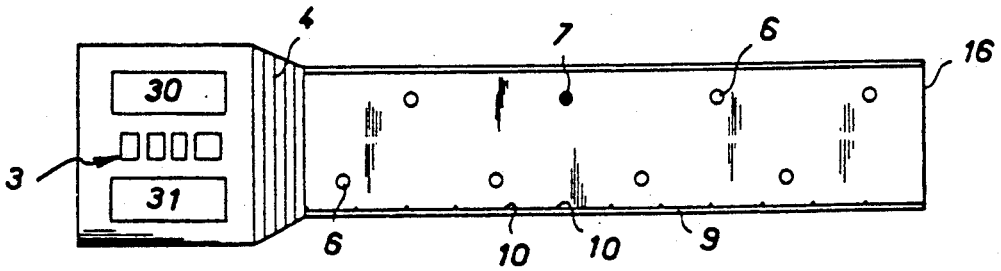
FIG. 3 is a plan view of the track.
Figure 4A:
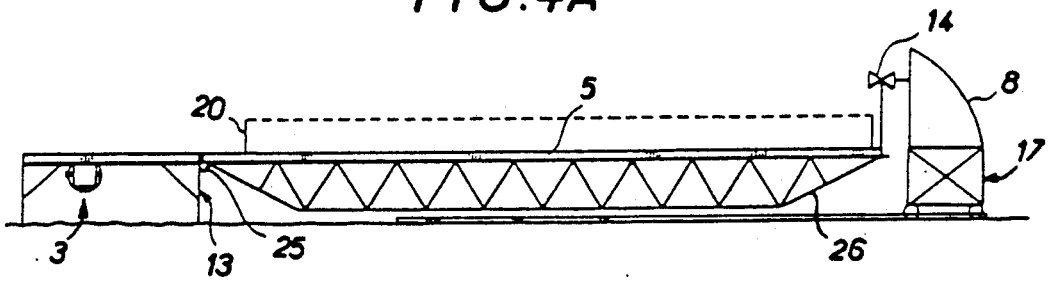
FIG. 4A is a view in elevation of the track in a longitudinally horizontal position.
Figure 4B:
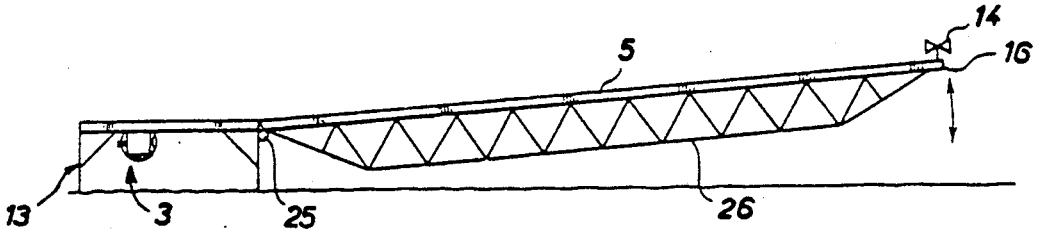
FIG. 4B is a view in elevation of the track with a longitudinal tilt.
Figures 5A, 5B, 5C, 5D:
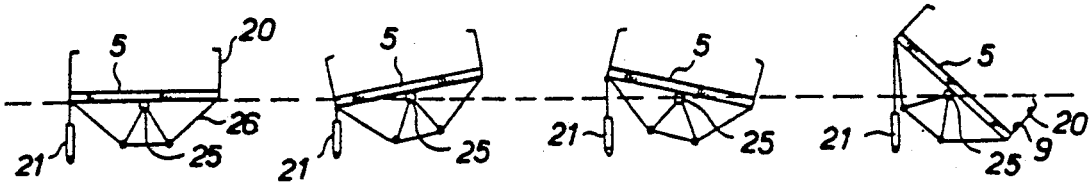
FIGS. 5A, 5B, 5C and 5D are transverse cross-sections through the track when respectively horizontal in the transverse direction, tilted towards the left, tilted towards the right, and strongly tilted towards the right to recover balls.

The driving area 3 shown in FIGS. 2A and 2B comprises in a centered longitudinal arrangement four stroke start areas 32, 33, 34 and 35; these are respectively a putting start area 35, a "tee" start area 34 shown in more detail in FIG. 2E, a "rough" start area 33 and a "bunker" start area 32. All of these start areas have a common feature, to be described with reference to the "tee" start area 34 (FIG. 2C), in that they are mounted on a plate 41 which occupies either of two positions at 180°, controlled by a motor 44. In a first position of every plate 41 one side of the plate with a coating simulating a green is flush with the ground of the driving area 3. In the second position the plate has a specific character: this means for the area 35 a simulated green, for the area 34 a tee 42 on which the ball B is placed, for the area 33 a simulated rough, and for the area 32 a depression simulating a bunker. All the areas have a rest position with the ball centered and comprise a vertical channel directed downwards and a photoelectric cell 43 on the axis of the channel. A light source fixed to the roof 2 vertically above the vertical channel directs a light beam towards the cell 43. As the ball B in the starting position closes off the entry to the channel the cell 43 is masked. It is therefore able to send a signal when the ball leaves its starting position when hit by a club. The use of this starting signal will be explained later.

It will have been understood that only one start area is uncovered for each stroke, this start area being chosen to correspond to the nature of the terrain from which the stroke is to be played. This will also be explained in the section of the description concerning operation of the device.

The driving area 3 comprises to either side of the aligned start areas 32 through 35 two symmetrical panels 30 and 31 the dimensions of which are such that a player can stand on one or other of the panels 30 and 31 to play the ball. The panel 30 to the left of the aligned areas is intended for a righthanded player and the panel 31 to their right is intended for a lefthanded player.

As seen more clearly in FIG. 2B the panels 30 and 31 can be inclined by a jack 36 the piston rod 37 of which operates two links 38 and 39 to achieve one extreme position with a downward slope towards the start area (shown in full outline) and another extreme position with an upward slope towards the start area. It will be understood that the purpose of this is to simulate uneven terrain on the golfcourse requiring an adjustment to the position of the player to play the ball.

Reference will now be made to FIGS. 3, 4A, 4B, 5A, 5B, 5C and 5D in order to describe the track 5. It will be noted that the specific features to be described relate for the most part to putting, where the results of previous strokes have simulated the ball approaching the hole to within a distance less than the length of the track.

The track 5 is joined to the driving area 3 by a flexible apron 4 to enable the track to be inclined relative to the driving area. As already mentioned, the track 5 has a covering simulating a green or fairway. Retractable holes 6 are distributed along the track and in this instance one hole 7 is open to constitute the objective.

The track (FIGS. 4A and 4B) rests on a frame in the form of a truss with a ball-joint articulation at its posterior end linked to the platform of the driving area 3. To the anterior end 16 are attached cables which can be wound onto a drum 14 of a winch to raise the anterior end 16 so that the track 5 slopes upwardly towards the anterior end. Also, as shown in FIGS. 5A through 5D, a jack 21 is coupled to a lateral edge of the track 5 and can be extended (FIGS. 5C and 5D) or retracted (FIG. 5B) to impart a lateral slope to the track 5. The inclinations represented in FIGS. 5B and 5C correspond to difficult strokes as compared with the FIG. 5A position. Also, the strong inclination to the right shown in FIG. 5D corresponds to a ball return maneuver: by virtue of this inclination balls will first be directed into a gully 9 between the track 5 and the edge member 20, to be then impelled towards the posterior end of the track 5 to enter a ball reservoir/dispenser 12 the outlet from which onto the playing area 1 can be seen in FIG. 1.

Note that the recovery gully 9 has photoelectric cells 10 along its length; a signal appears at the cells 10 when the ball masks them in returning to the posterior part of the track 5. This provides information as to the distance travelled by the ball.

Figure 6A:
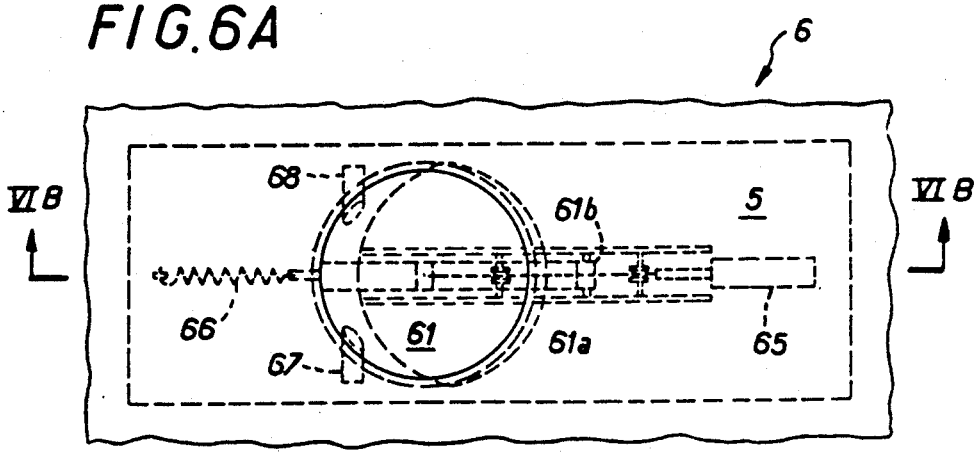
FIG. 6A is a plan view of a retractable hole.
Figure 6B:
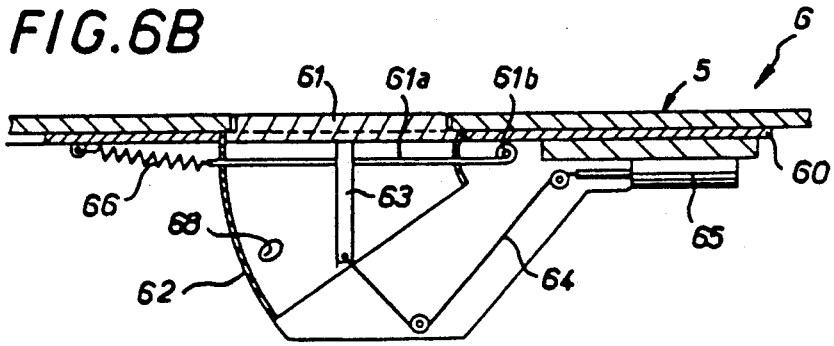
FIG. 6B is a cross-section on the line VIB—VIB in FIG. 6A.

As shown in FIGS. 6A and 6B the retractable hole comprises a fixing plate 60 in which is a circular orifice the diameter of which corresponds to conventional golfcourse holes. In this circular orifice is accommodated a circular closure member 61 with the same surface coating as the track 5. The closure member 61 is fitted with a central depending rod 63 which is fixed to a blade member **61*a* parallel to the closure member 61 with a hinge 61*b* at one end and a return spring 66** at the other end.

The circular orifice that the closure member 61 closes off is extended downwardly by a skirt 62 which is a sector of a torus the axis of which is coincident with the axis of the hinge **61*b* and in which are slots for the blade member 61*a* to pass through. Coupled to the base of the central stem 63 is a cord 64 coupled at the other end to the piston rod of a jack 65. It will be understood that retraction of the jack 65 will lower the closure member 61 which pivots about the hinge 61*b* substantially as far as the lower end of the skirt 62**.

Towards the exterior of the skirt 62 are two peepholes 67 and 68 one containing a light source and the other containing a photoelectric cell. When the hole 6 is opened by lowering the closure member 61 the entry of a ball into the hole interrupts the optical path between the peep-holes 67 and 68. Expansion of the jack 65 releases the closure member 61 and the blade member 61*a* which is attached to it through the intermediary of the central stem 63. The spring 66 then returns the combination of the pivoting blade member 61*a* and the closure member 61 until the latter is level with the track 5, expelling the ball which had entered the hole 6.

Figure 7A:
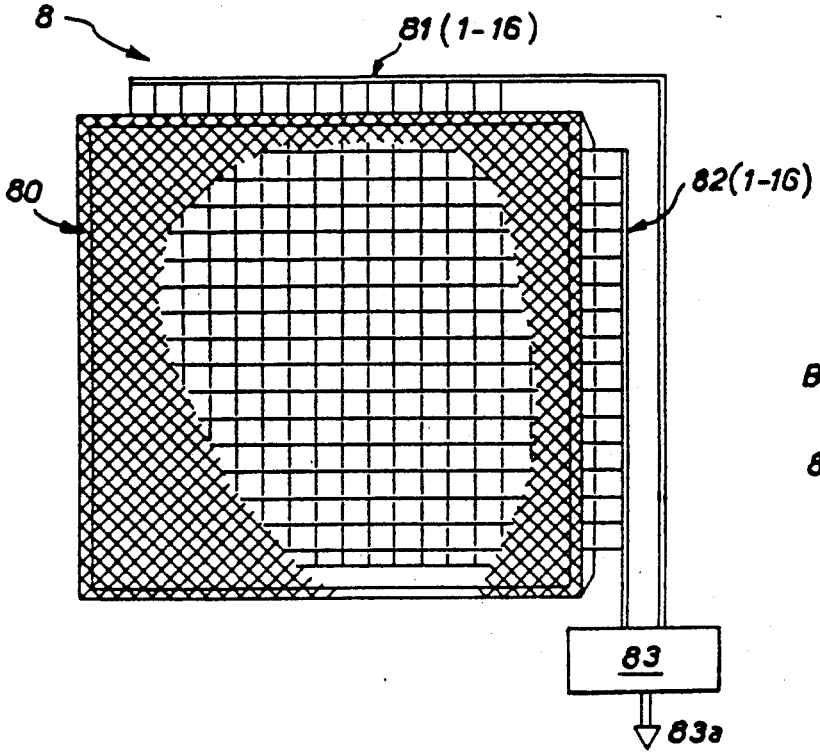
FIG. 7A is a view in elevation of the target with the protective mat partially cut away.
Figure 7B:
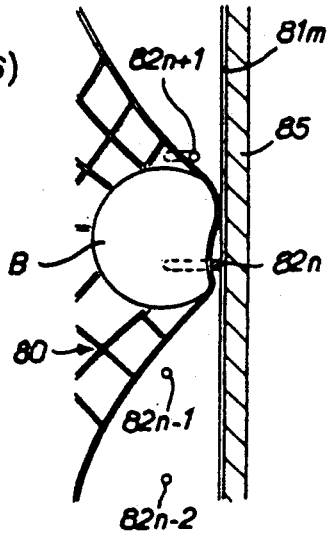
FIG. 7B shows in cross-section a detail of the target during the impact of the ball.

The target 8 shown in FIGS. 7A and 7B is a rectangular frame closed by a stop panel 85. It comprises a first layer of equidistant vertical wires 81(1-16) resting against the stop panel 85 and a second layer parallel to the first layer made up of equidistant horizontal wires 82(1-16). The wires 82(1-16) are tensioned elastically so that they are near the first layer 81 but not in contact with it. In front of the two layers 81 and 82 is a flexible mat 80 which is capable of absorbing the impact of balls B. As shown in FIG. 7B the impact of a ball B from the playing area drives the mat 80 towards the stop panel 85. As a consequence of this wires 82($n$) and 82($m+1$) of the layer 82 are deformed by the mat 80 and the wire 82($n$) comes into contact with wire 81($m$) of the layer 81.

The arrays of wires 81(1-16) and 82(1-16) terminate at a matrix coder 83 which sends from an output 83*a* an impact address signal m, n corresponding to the point of impact on the target 8.

Note that it is possible to double the resolution of the target by assigning address components of the form $m+\frac{1}{2}$ or $n+\frac{1}{2}$ if two wires of index m and $m+1$ or n and $n+1$ are in contact simultaneously at the time of impact.

Note also that the stop panel 85 may constitute an image synthesizer screen, as will be explained later.

As already mentioned, the use of the golfcourse simulator device entails two playing phases for each course stage (hole) from a start area to an objective hole, the first phase corresponding to swings and the second phase to putting. It was also pointed out that FIGS. 3, 4A, 4B, 5A–5D, 6A, 6B were essentially concerned with putting executed over a distance less than the length of the track 5.

Swings must be simulated and the location of the ball after the stroke reconstituted in a virtual space which, neglecting for the time being the possibility of longitudinal displacement of the target 8, begins beyond the target 8.

To locate the end of the trajectory of the ball the first step is to establish stroke parameters which will essentially be an initial speed of the ball, a lift angle (angle in a vertical plane with which the ball leaves the horizontal plane passing through the origin of the trajectory), and a drift angle (angle in a horizontal plane by which the trajectory at the origin departs from the aiming line).

For simulating swings the target is placed at a known distance from the area from which the ball is played; the initial speed will be the quotient on dividing the duration separating a start signal emitted by the photocell 43 as described with reference to FIG. 2C and contact between the wires 81*m* and 82*n* as described with reference to FIG. 7B. Also, the index n of the wire of the layer 82 in contact with the wire 81*m* will be representative of the angle of lift while the number $m-8$ where m is the index of the wire of the layer 81 in contact with a wire of the layer 82 will be representative of the drift, the sign of this drift indicating whether it is to the right or to the left.

Figure 8:
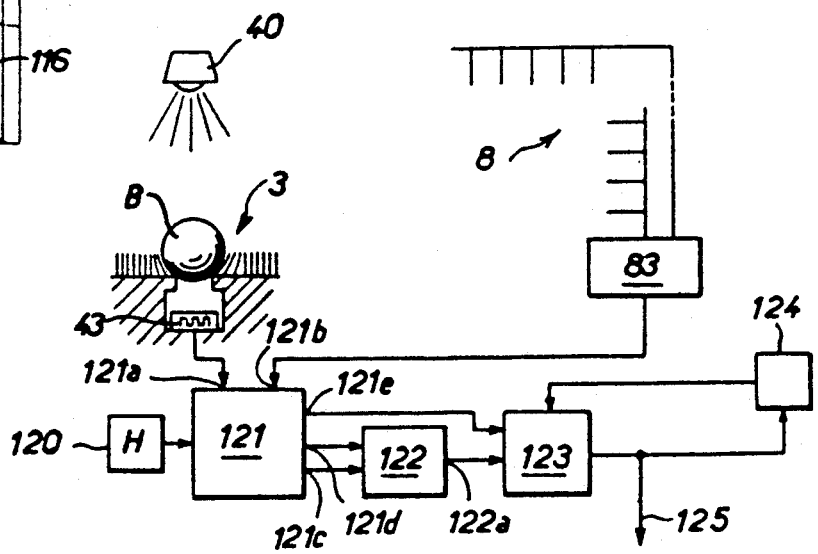
FIG. 8 is a schematic of a circuit for determining stroke parameters.

FIG. 8 is a schematic representation of a circuit for determining stroke parameters and stringing to the next stroke.

The figure shows a start area 3 at which a ball B intercepts the light emitted by the source 40 towards the photocell 43 and the matrix coder 83 connected to the target 8. A calculator circuit 121 provided with a clock 120 receives on a first input 121*a* the signal sent by the photocell 43 and on a second input the signals sent by the matrix coder 83. The signal sent by the photocell 43 triggers the counting of pulses from the clock 120 which is stopped by the signal indicating contact between two wires of the target 8 transmitted by the matrix code 83. The calculator 121 then determines the initial speed given the actual distance from the start area to the target and places the initial speed value on the output 121*c*. It also indicates the tangent of the angle of lift deduced from the index n (on the output 121*d*) and the angle of drift deduced from the index m (on the output 121*e*).

The initial speed signal on the output 121*c* and the lift angle tangent signal on the output 121*d* are applied conjointly to a read-only memory 122 organised as a stroke table in which are recorded ranges defined by a pair of initial speed and lift angle tangent values taken from a double multiplicity of discrete values.

The stroke table 122 is constructed from a number of experimental values by appropriate interpolation.

The range appears at the output 122*a* and is applied conjointly with the drift angle appearing at the output 121*e* to a calculator 123 for determining the trajectory which, as will be explained in more detail later, converts polar coordinates defined relative to a pole at the origin of the stroke, the polar coordinates consisting of the range and the drift angle, into polar coordinates defined relative to a pole at the objective hole. This latter pair of signals (distance and bearing of the end of the trajectory relative to the objective hole) is memorized at 124 to initialize the calculator 123 for the next stroke and is directed via an output 125 to other control circuits.

This is because the circuit shown in FIG. 8 is naturally integrated into a controlling microcomputer programmed to define a series of course stages (holes), to determine the progress of the ball in, the virtual space by the process previously described, to determine the moment at which a stroke corresponds to entry of the objective hole into the real space, to open a hole 7 at the distance from the driving area corresponding to the distance between the end of the previous stroke and the objective hole, then to determine (from the length of the stroke measured by means of the cells 10 along the length of the track 5 when the tilting shown in FIG. 5E causes the balls to be returned to the reservoir/ dispenser 12) the hole 6 to be opened for the next stroke, and so on in this way until the ball is played into the objective hole, to start the next course stage. Of course, the microcomputer records and displays (at 11 in FIG. 1) the player's performance, in particular the number of strokes needed to complete the stage and also a total for the stages already completed.

Figure 9:
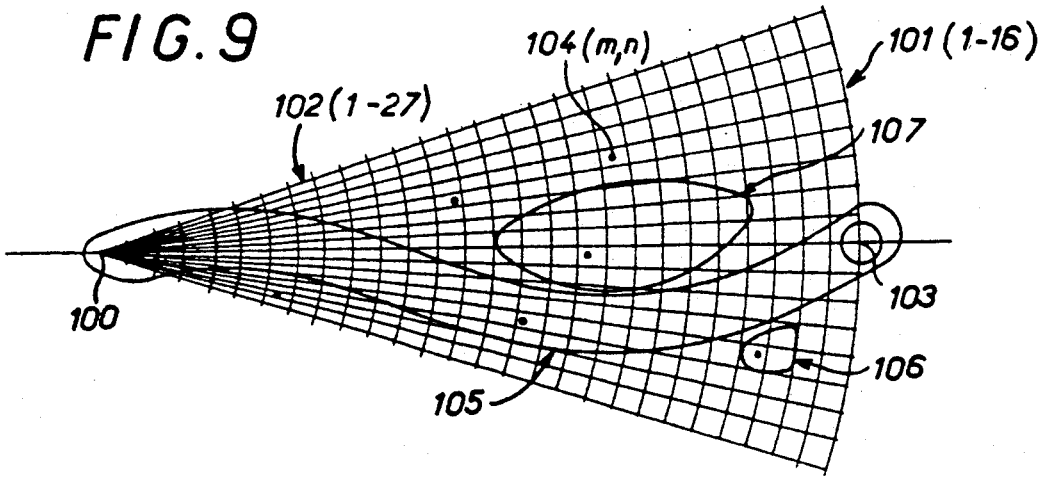
FIG. 9 is a memorized schematic of the virtual space between a stroke start area and an objective hole on which is located the arrival point of a stroke.

FIG. 9 is a schematic representation of the configuration of a field corresponding to a course stage from a pole 100 corresponding to the stage start area (the "tee" start area 34) to an objective 103 corresponding to the objective hole. This field comprises a plurality of cells such as the cell 104 delimited laterally by two rays of a beam 101(1-16) the rays in which are angularly equidistant. It is delimited longitudinally by two circular arcs of a plurality 102(1-27) of arcs with their radius increasing in regular increments. It will be readily understood that the address of a cell 101*p*, 102*q* is defined by the angle of drift and the range of a stroke assumed to be executed from the pole 100.

The microcomputer includes a memory in which data specific to each cell is stored in a respective memory location with address p, q, this data comprising the distance to the objective hole, the orientation of the polar ray (103, 104) the nature of the terrain (fairway 105 or bunker 106 or water 107 or rough if no contrary indication) and the transverse slope of the terrain, all this numerically encoded data being used to control the driving area 3 (choice of one start area 32 through 35, inclination of the panels 30 and 31 on which the player stands).

Figure 11:
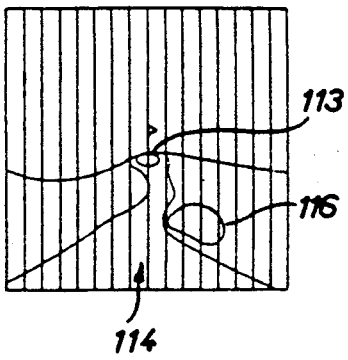
FIG. 11 shows a typical synthesized image displayed on the target when the objective hole is in the virtual space.

Each memory location contains information for recalling from floppy disk type memory assigned to the current field elements for forming an image to be addressed to the image synthesizer disposed conjointly with the target 8, this image reconstituting the appearance of the field centered on the objective hole as seen from the cell 104 at which the previous stroke ended. FIG. 11 shows an image of this kind with at the centre the hole 113 and its flag, a fairway 114 and a bunker 116. Above the target screen 8 is an area for displaying alphanumeric information of interest to the player, in particular the distance to the hole 103 and the stroke start cell 104.

Figure 10:
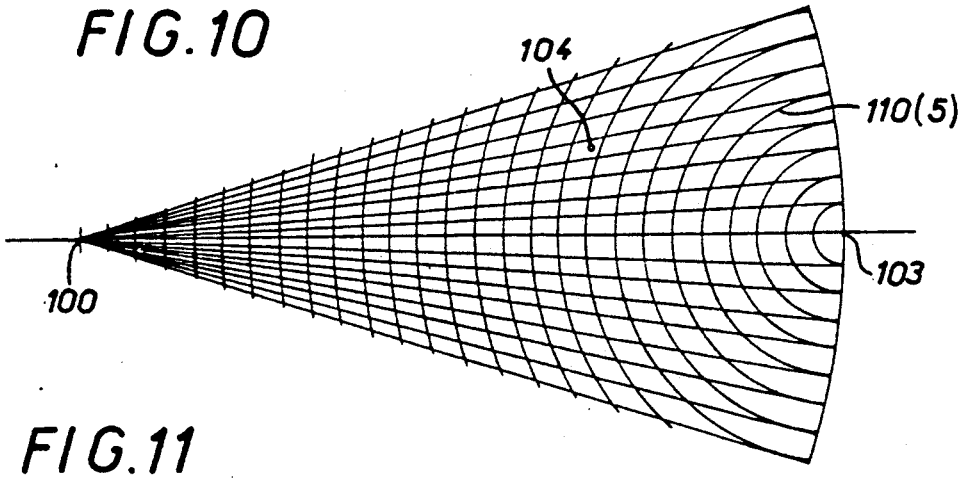
FIG. 10 is a schematic of the virtual space between the stroke start area and the objective hole, for determining the objective parameters for an intermediate stroke.

The foregoing comments with reference to FIG. 9 have so far considered only the first stroke, from the "tee" start area 34. As shown in FIG. 10 there may be superimposed on the field shown in FIG. 9 a plurality of circular arcs 110 with radii increasing with equal increments (the same increment as for the arcs 102(1-27)), the position of the terminal point 104 of the preceding stroke lying between two consecutive circular arcs 110 to define the distance to be taken into account for the next stroke.

To bring the point 104 to the point 100 for the next stroke the scale is changed by a factor which is the quotient of dividing the distance 100-103 by the distance 103-104, after which the field is rotated through the angle 104-103-100. The range and the drift angle for the next stroke will therefore be corrected to allow for the change of scale and the pivoting of the field to determine the cell at which the next stroke terminates.

In this way it is possible to string the strokes until the objective hole is situated in the real space, where the course is continued by opening successive holes 6.

It will be noted that the computations performed by the microcomputer have been mentioned here only to illustrate the operation of the various hardware devices by the programmed control means in an ordered process whereby the hardware devices cooperate to simulate effectively a golfcourse from the start area of the first stage (hole) to the last hole. In themselves these computations are outside the scope of the invention and their execution could be modified provided that they determine the simulation of the progress of the ball by successive actual strokes on the stage field between the start area and the stage objective hole.

Moreover, the invention is not limited to the examples described but encompasses all variant executions thereof within the scope of the claims.

I claim:

1. A golfcource simulator device comprising a series of holes into which a player must direct a ball in corresponding successive stages in each of which one hole constitutes a stage of objective to which the ball advances from a start area, the player playing all his strokes from the same point and the progress of the ball along the course being simulated by displacement of the objective hole according to parameters of the preceding stroke, said device comprising a driving area, a first ball sensor in said driving area, an elongated track extending from said driving area, a plurality of selectively openable and closable holes on said track, a plurality of second ball sensors each associated with a respective hole, a plurality of third ball sensors disposed along the length of said track to determine the farthest position reached by a ball on said track after a stroke, a target closing said track sat the end opposite said driving area and separating a real space between it and said driving area and a virtual space on the side of said target opposite said driving area, a plurality of impact sensors on said target and control means including a programmed computer comprising means;

defining the series of stages each corresponding to a field extending from a start area to an objective hole and subdivided into an ordered plurality of contiguous cells memorized in said computer in the form of a file comprising plurality of blocks of information each associated with a respective one of said cells of said field and each containing data for identifying the associated cell relative to the start area and the objective hole for the stage in question;

determining stroke parameters either from conditions of impact on said target or from the position of the ball on said track after the stroke according to whether the objective hole for the cell in which the origin of the stroke is simulated is in said virtual space or in said real space, respectively;

determining the cell of said field in which the ball is located after a stroke from the stroke parameters and the cell reached after the preceding stroke;

retrieving from said file objective parameters associated with the cell reached after the preceding stroke, which parameters condition the opening of a particular hole on said track if said cell is in said real space; and registering the end of a stage in response to activation of one of said second ball sensors corresponding to entry of the ball into the opened hole.

2. The device according to claim 1 comprising an image synthesizer connected to said computer and defining means to produce a synthesized image on said target, each information block in said file which is associated with a cell of the stage field for which the objective hole is in said virtual space comprising data on the basis of which said synthesizer synthesizes a schematic panoramic view of the stage field as seen from the associated cell looking towards the objective hole.

3. The device according to claim 2 wherein said information blocks further comprise objective information displayable in alphanumeric form on said target.

4. The device according to claim 1 wherein said driving area comprises a plurality of stroke start areas each simulating a respective type of terrain and exposable individually in response to specific data in the information block associated with the stage field in which the ball is located after the previous stroke.

5. The device according to claim 4 wherein said first ball sensor comprises at each stroke start area a respective photo-electric device disposed below an orifice defining a ball support whereby placing a ball on said support cuts off illumination of said photo-electric device.

6. The device according to claim 1 wherein said driving area comprises at least one tiltable ground panel on which the player stands to play a stroke and means for controlling the inclination of said at least one tiltable ground panel according to specific data in the information block associated with the stage field in which the ball is situated after the preceding stroke.

7. The device according to claim 6 wherein said driving area comprises two tiltable ground panels in conjugate positions to either side of a longitudinal axis passing through the stroke start areas.

8. The device according to claim 1 wherein said track is tiltable according to commands received from said control means.

9. The device according to claim 8 wherein said track is tiltable longitudinally.

10. The device according to claim 8 wherein said track is tiltable transversely.

11. The device according to claim 10 wherein said track is tiltably mounted transversely to a degree sufficient to cause a ball to roll down the resulting transverse slope and further comprising a longitudinal gully running alongside said track to receive a ball after it has rolled down said transverse slope, returning a received ball to said driving area and equipped with third ball sensors which are disposed along the length of said gully.

12. The device according to claim 1 comprising a control device connected to said plurality of selectively openable and closable holes openable only one at a time according to commands received from said control means.

13. The device according to claim 12 wherein each hole comprises a tubular wall in the shape of a sector of torus with a centerline in a plane perpendicular to the surface of said track and a closure member movable along said line between a lowered open position and a raised closed position.

14. The device according to claim 1 wherein said target comprises a vertical rigid stop panel and in longitudinal succession from said panel towards said driving area a first layer of rectilinear, parallel and regularly spaced conductors resting on the stop panel, a second layer of rectilinear, parallel and regularly spaced elastic conductors disposed parallel to the first layer with a gap between said layers, the conductors of one layer being horizontal and the conductors of the other layer being vertical, and a flexible mat parallel to the stop panel and spaced from said second layer, the distances from said mat and said second layer to said stop panel being such that the impact of a ball on said mat pushes at least one conductor of said second layer into contact with at least one conductor of said first layer in line with the point of impact.

15. The device according to claim 14 further comprising a matrix encoder with inputs to which the conductors of each layer are connected.

16. The device according to claim 14 wherein said means defined by said computer comprises a clock and means for measuring a ball flight duration between a first signal sent by a first ball sensor when the ball departs and a second signal sent by said target in response to contact of conductor of said second layer with a conductor of said first layer, assigning an address to the impact according to the rank of the conductors in contact in said first and second layers, defining initial stroke parameters from the flight duration as so measured and the address of the impact, and producing final stroke parameters on the basis of the initial parameters by looking up a stroke table.

17. The device according to claim 1 wherein said target is mobile longitudinally whereby it can be placed at any of a plurality of predetermined distances from said driving area.

18. The device according to claim 1 comprising protective nets forming a corridor between said driving area and said target with top and side walls through which a ball cannot pass.

* * * * *